US006030135A

United States Patent [19]

Imai

[11] Patent Number: 6,030,135

[45] Date of Patent: Feb. 29, 2000

[54] THERMAL LABEL PRINTER WITH AUTOMATIC AND MANUAL CUTTING MEANS

[75] Inventor: Kazuhide Imai, Fuchu, Japan

[73] Assignee: Casio Computer Co., Ltd., Tokyo, Japan

[21] Appl. No.: 09/242,154

[22] PCT Filed: Jun. 10, 1998

[86] PCT No.: PCT/JP98/02558

§ 371 Date: Feb. 9, 1999

§ 102(e) Date: Feb. 9, 1999

[87] PCT Pub. No.: WO98/56547

PCT Pub. Date: Dec. 17, 1998

[30] Foreign Application Priority Data

Jun. 11, 1997 [JP] Japan ..... 9-153223

[51] Int. Cl.[7] ..... B41J 11/70

[52] U.S. Cl. ..... 400/621; 400/88; 400/615.2; 83/602; 83/603; 83/629

[58] Field of Search ..... 400/621, 88, 615.2; 101/288; 81/607, 602, 603, 629, 589, 588

[56] References Cited

U.S. PATENT DOCUMENTS

| | | | |
|---|---|---|---|
| 3,850,068 | 11/1974 | Bradam | 83/607 |
| 4,398,441 | 8/1983 | Jue | 83/607 |
| 4,491,046 | 1/1985 | Hosogaya | 83/602 |
| 4,544,293 | 10/1985 | Cranston et al. | 83/602 |

FOREIGN PATENT DOCUMENTS 0 767 066 A2 4/1997 European Pat. Off. .

OTHER PUBLICATIONS

Patent Abstracts of Japan, vol. 018, No. 474 (M–1668), Sep. 5, 1994 & JP 06–155385 (Casio Computer Co., Ltd.), Jun. 3, 1994.

*Primary Examiner*—John Hilten
*Assistant Examiner*—Daniel J. Colilla
*Attorney, Agent, or Firm*—Frishauf, Holtz, Goodman, Langer & Chick, P.C.

[57] ABSTRACT

In a tape cutting mechanism, when a tape is cut manually, a rack 58 which is lowered by pushing a push button 14 down meshes with a gear 48 by guidance of a guide groove 59 to thereby cause a scissors cam 46 to make a single complete rotation along with a pin 46*b* around a cam shaft 47. The pin 46*b* half rotates to raise a turnable arm 52*b* up so that a turnable blade 52*a* is turned toward a fixed blade 55 to cut a printed tape portion. By the remaining half rotation, the turnable arm 52*b* is returned to its reference position. When the rack 58 rises with the resiliency of a compression spring 57 due to release of the push button 14 from its pushed state, the rack 58 is disengaged from the gear 48 with the guide of the guide groove 59. When the tape is cut automatically, the motor 37 is rotated, the scissors cam 46 is rotated along with the pin 46*b* via a worm 38, worm wheel 29, smaller gear 40, reduction gear 41, spur gear 43, bevel gears 42, 44, one-way clutch 45 and cam shaft 47 to cause the rotatable and fixed blades 52*a* and 55 to cooperate to cut the printed tape portion.

7 Claims, 11 Drawing Sheets

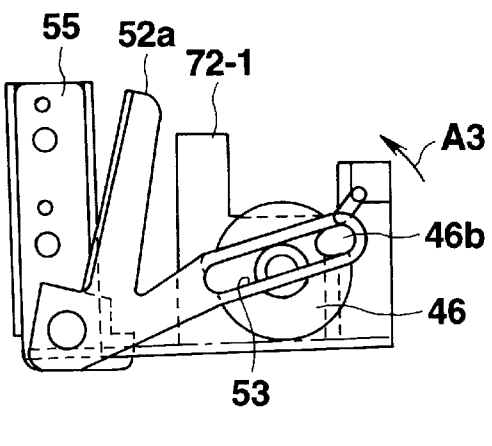
FIG.6A
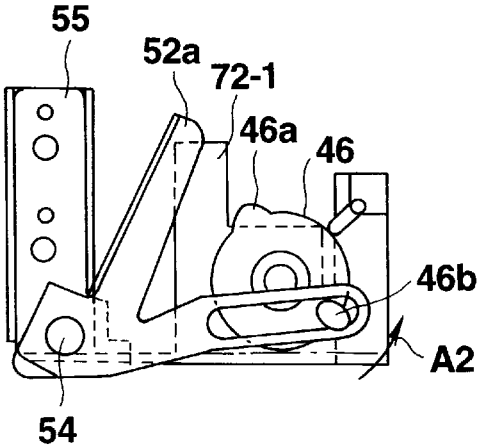
FIG.6B
FIG.6C
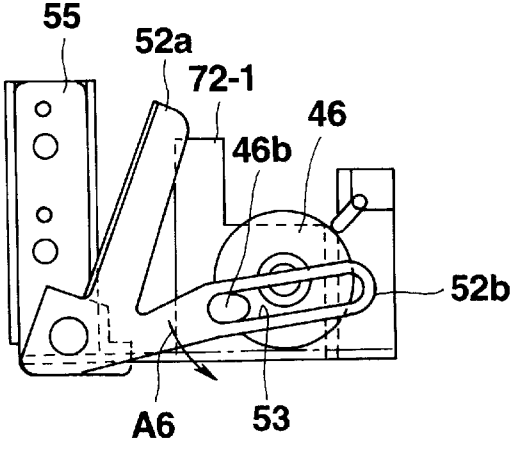
FIG.6D
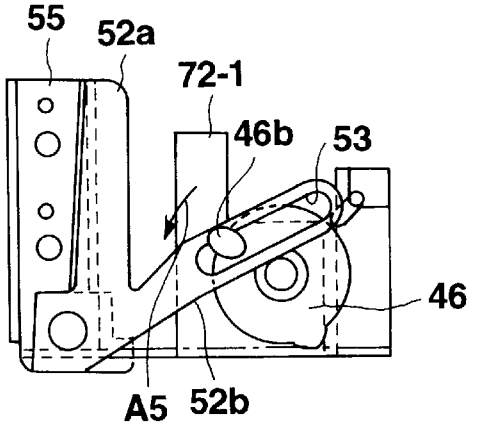
FIG.6E
FIG.6F

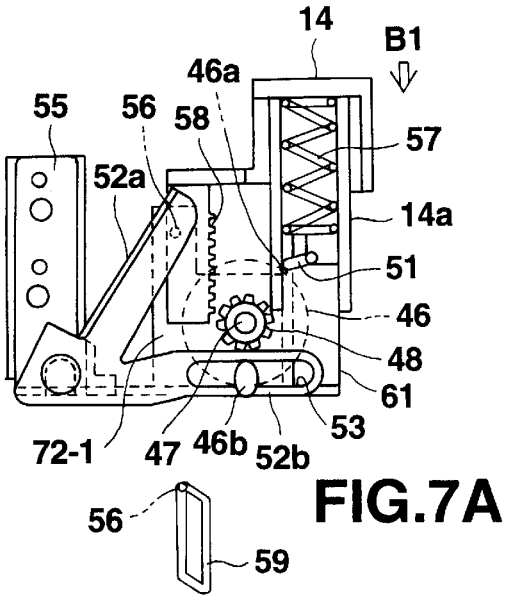
FIG.7A
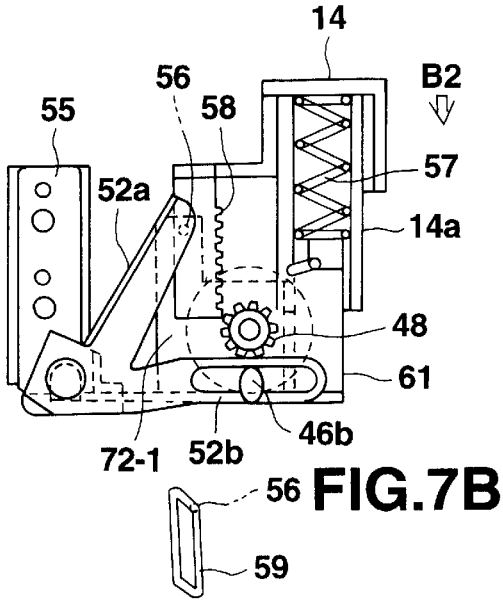
FIG.7B
FIG.8A
FIG.8B
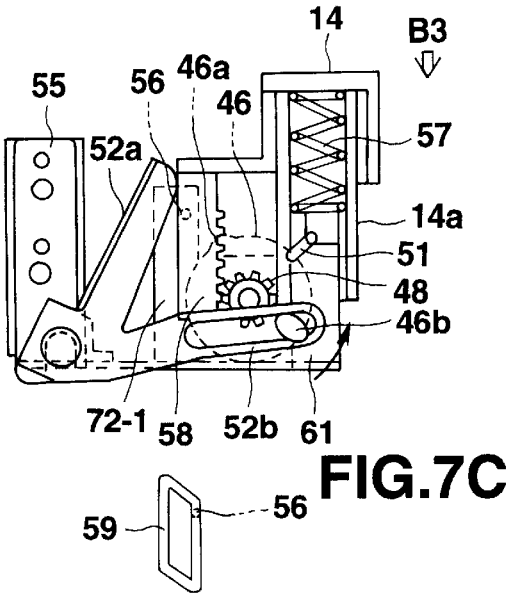
FIG.7C
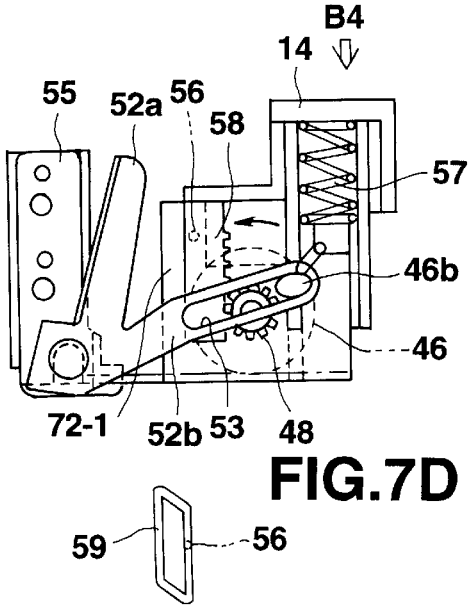
FIG.7D
FIG.8C
FIG.8D

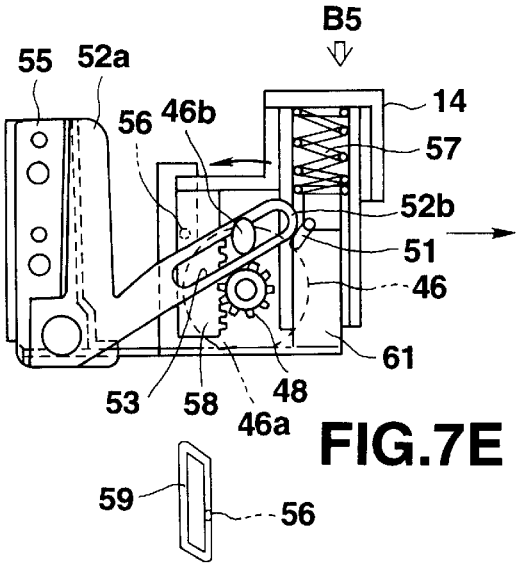
FIG.7E
FIG.8E
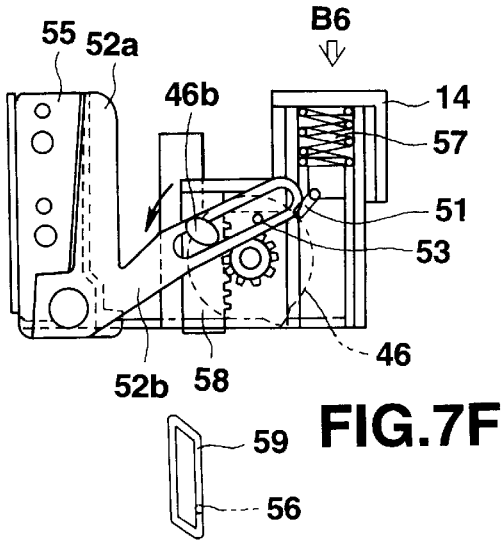
FIG.7F
FIG.8F
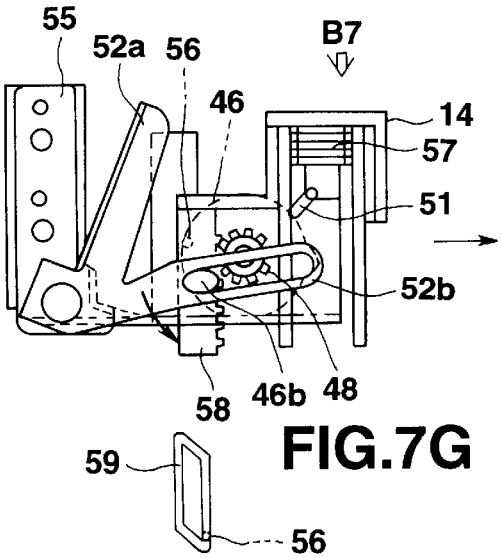
FIG.7G
FIG.8G
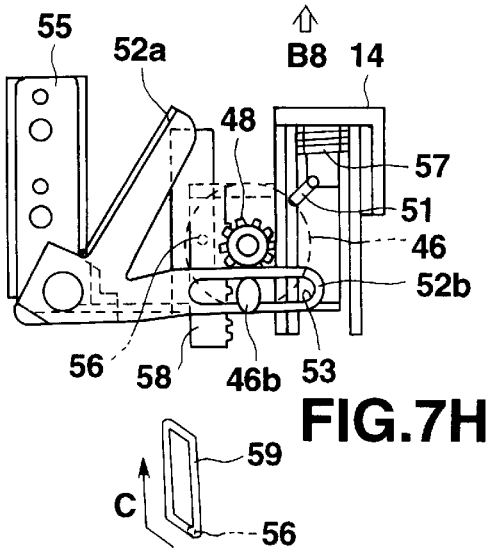
FIG.7H
FIG.8H

THERMAL LABEL PRINTER WITH AUTOMATIC AND MANUAL CUTTING MEANS

TECHNICAL FIELD

The present invention relates to printers which automatically or manually cut a tape-like printed medium.

BACKGROUND ART

Conventionally, small office devices or household devices usually called tape or label printers capable of easily printing characters on a tape-like printing medium are commercially available. In such tape printer, after characters are printed though a predetermined length on the tape-like printing medium, the printed tape portion is cut by a tape cutter from the remaining tape and then used. In that case, many tape cutters used are inexpensive and arranged so as to manually operate a cut lever or button to operate a pair of scissors or cutter blades.

One automatically cutting device for such printed medium has a pin slidably placed in a groove provided on an outer peripheral surface of a cylindrical cam and engaged with an opposite side of a cutter blade from its edge so that when the cylindrical cam is rotated, the cutter blade is actuated to cut a printed medium.

In a cutting device such as the aforementioned manually cutting device in which an operating member (cut lever or cut button) connected to a pair of scissors (or a cut blade) is pushed down to cut a printed tape or medium fed out from a tape printer (hereinafter referred to as a "printer" simply), an attendant for the printer is required in printing. Thus, there is dissatisfaction that the attendant cannot do any other business or work. The attendant manually cuts the printed tape at an end of each printing operation, so that when the attendant successively forms the printed tape portions, a lot of trouble and time is taken unsatisfactorily.

In a printer such as the above-mentioned automatically cutting device in which a pair of scissors is operated by a cylindrical cam to cut a printed tape, a rechargeable cell is used in many cases as a power supply to give portability to the printer. In that case, when the cell is dead, a time for recharging the cell is required. Alternatively, to get power through an AC adapter, the user is required to move to the position of a receptacle for a home power source or extend a code to the receptacle to thereby ensure a power supply, which is, however, inconvenient because a makeshift to deal with an emergency cannot be devised.

Not only when a printer is used frequently, but also when the printer is left for a long time in an unused state, for example, within a desk, the output of the cell will drop below a usable level to thereby cause a problem of running out of the cell as in the case of its frequent use.

DISCLOSURE OF INVENTION

It is therefore an object of the present invention to provide a tape cutting device which is capable of freely selecting any one of the automatic and manual cutting operations.

In order to achieve the above object, according to the present invention, there is provided a printer for printing an image or character on a tape-like printing medium, comprising:

a cutter member for cutting the printing medium;

a cutter drive source;

a drive force transmitting means for transmitting a drive force from the cutter drive source to the cutter member for operate the cutter member; and a manually operating mechanism for manually operating the cutter member independent of the operation of the cutter member based on the cutter drive source.

Therefore, according to the inventive printer, a tape-like printed medium can be automatically cut. In addition, even when the problem of inability to automatically cut the printed medium which will occur when the cell output drops is solved. For example, even when security of a power supply is required because of the cell being dead, but a makeshift to deal with such emergency cannot be devised with a conventional device, it is ensured according to the present invention that a printed medium is cut automatically or manually by corresponding independent mechanisms even in the emergency, and handiness of the printer is improved. The same cutter member is used for the respective independent automatic and manual cutting operations, so that even in any one of the automatic cutting composition, manual cutting composition, and automatic and manual cutting composition, their components are used in common to easily assemble a printer body without changing the specifications of components to be used. Thus, the molding cost and hence manufactured article cost are reduced.

BRIEF DESCRIPTION OF DRAWINGS

FIG. 6A illustrates a state of operation of a scissors cam and its turnable blade driven by a motor;

FIG. 6B illustrates another state of operation of the scissors cam and its turnable blade driven by the motor;

FIG. 6C illustrates still another state of operation of the scissors cam and its turnable blade driven by the motor;

FIG. 6D illustrates a further state of operation of the scissors cam and its turnable blade driven by the motor;

FIG. 6E illustrates a still further state of operation of the scissors cam and its turnable blade driven by the motor;

FIG. 6F illustrates another different state of operation of the scissors cam and its turnable blade driven by the motor;

FIG. 7A illustrates a state of a manual cutting operation by the push button;

FIG. 7B illustrates another state of the manual cutting operation by the push button;

FIG. 7C illustrates still another state of the manual cutting operation by the push button;

FIG. 7D illustrates a further state of the manual cutting operation by the push button;

FIG. 7E illustrates a still further state of the manual cutting operation by the push button;

FIG. 7F illustrates still another state of the manual cutting operation by the push button;

FIG. 7G illustrates a further state of the manual cutting operation by the push button;

FIG. 7H illustrates a still further state of the manual cutting operation by the push button;

FIG. 8A shows a positional relationship between a guide groove and a rack pin guided in the guide groove when a printed medium is manually cut with the FIG. 7A push button, FIG. 8A corresponding to FIG. 7A;

FIG. 8B shows another positional relationship between the guide groove and the rack pin guided in the guide groove when the printed medium is manually cut with the FIG. 7A push button, FIG. 8B corresponding to FIG. 7B;

FIG. 8C shows still another positional relationship between the guide groove and the rack pin guided in the guide groove when the printed medium is manually cut with the FIG. 7C push button, FIG. 8C corresponding to FIG. 7C;

FIG. 8D shows a further positional relationship between the guide groove and of the rack pin guided in the guide groove when the printed medium is manually cut with the FIG. 7D push button, FIG. 8D corresponding to FIG. 7D;

FIG. 8E shows a further positional relationship between the guide groove and the rack pin guided in the guide groove when a printed medium is manually cut with the FIG. 7E push button, FIG. 8E corresponding to FIG. 7E;

FIG. 8F shows a still further positional relationship between the guide groove and the rack pin guided in the guide groove when the printed medium is manually cut with the FIG. 7F push button, FIG. 8F corresponding to FIG. 7F;

FIG. 8G shows still another positional relationship between the guide groove and the rack pin guided in the guide groove when the printed medium is manually cut with the FIG. 7G push button, FIG. 8G corresponding to FIG. 7G;

FIG. 8H shows a further positional relationship between the guide groove and of the rack pin guided in the guide groove when the printed medium is manually cut with the FIG. 7H push button, FIG. 8H corresponding to FIG. 7H;

DETAILED DESCRIPTION

First Embodiment

Figure 1:
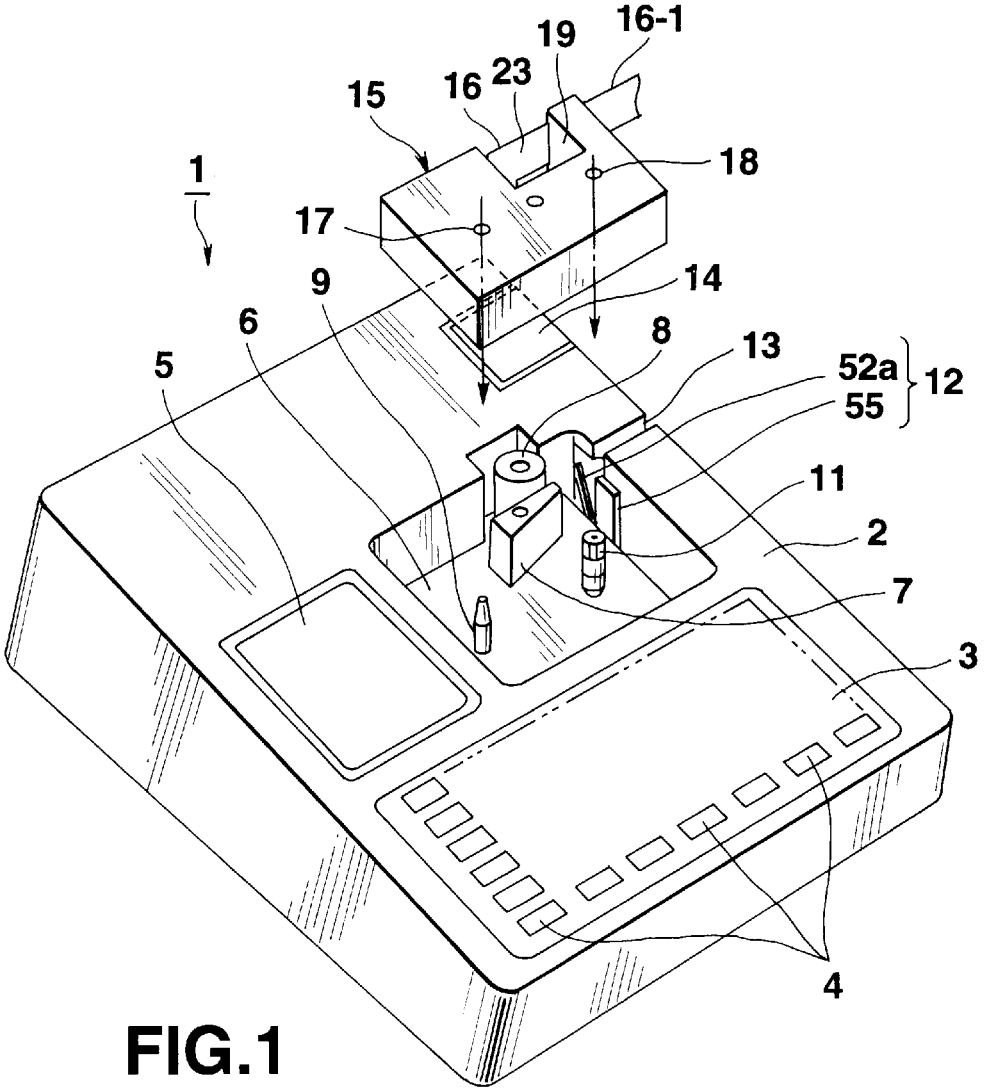
FIG. 1 is a perspective view of a printer according to a first embodiment of the present invention, shown along with a tape cassette.
Figure 2:
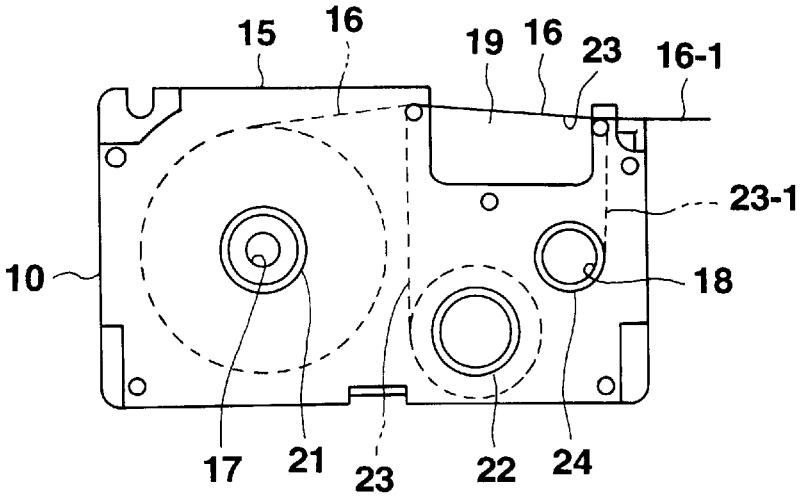
FIG. 2 is a plan view of the tape cassette.

FIG. 1 is a perspective view of a printer of a first embodiment according to the present invention. In FIG. 1, a tape cassette set and used in the printer is also shown. FIG. 2 is a plan view of the tape cassette.

In FIGS. 1 and 2, the printer 1 is provided with a key-in unit 3 in one end portion of a top surface of a housing 2. The key-in unit 3 includes a plurality of operation keys 4 which are cursor keys, a form setting key, a print key, a cancel key, function keys, a print magnification key, a capital/small letter select key, a shift key, a single-Chinese character key, a conversion key, a non-conversion key, an enter key, and character input keys which input both kana and alphanumeric characters.

A display unit 5 composed of a liquid crystal display is disposed in a left portion of a central area of the top surface next to the key-in unit 3, and a tape cassette accommodating space 6 is formed to the right of the display unit 5 in the central area. In FIG. 1, the tape cassette accommodating space 6 is shown with a cover being removed away so that the inside of the tape cassette accommodating space may be seen well. A thermal head 7 is disposed so as to be turnable around a vertical shaft within the tape cassette accommodating space 6. A platen roller 8 is disposed opposite the thermal head 7 so as to be slightly biased toward the thermal head 7. A tape reel support pin 9 and an ink ribbon winding drive shaft 11 are disposed between the thermal head 7 and the key-in unit 3 within the cassette accommodating space 6. A tape cutter 12 having a fixed blade 55 and a turnable blade 52*a* is disposed at a side of the cassette accommodating space 6 to the right of the thermal head 7. A tape discharge port 13 is formed on the right of the tape cutter 12. A push button 14 is disposed near the tape discharge port 13 on the other end portion of the top surface of the housing 2.

When a tape cassette 15 is set in the tape cassette accommodating space 6, the tape reel support pin 9 is engaged in a tape reel hole 17 in the tape cassette 15 which contains a roll of tape 16, and the ink ribbon winding drive shaft 11 is engaged in an ink ribbon winding reel hole 18 in the tape cassette 15.

In the tape cassette 15, the roll of tape 16 is formed on a tape reel 21 within a cassette case 10, and a roll of ribbon 23 is formed on the ink ribbon reel 22. The tape 16 and the ink ribbon 23 extend in a superimposed relationship across a recess 19 (which receives a head) formed in the tape cassette 15. The thermal head 7 of the printer 1 is disposed within the recess 19. The thermal head 7 and the platen roller 8 are disposed so as to receive the tape 16 and the ink ribbon 23 therebetween.

In printing, the thermal head turns toward the platen roller 8 so that the heating elements disposed at an end of the thermal head 7 press through the ink ribbon 23 and the tape 16 against the platen roller 8 to thermally transfer an ink in the ink ribbon 23 to a printing surface of the tape 16. The ink-transferred portion 23-1 of the ink ribbon 23 is wound around the ink ribbon winding reel 24, so that an unused portion of the ink ribbon 23 is fed out from the ink ribbon reel 22 into the printing region.

By a counterclockwise rotation of the platen roller 8, an unused portion of the tape 16 is fed out from the tape reel 21 while the printed portion 16-1 of the tape 16 is discharged from the tape discharge port 13 via the tape cutter 12. The fed-out printed tape portion 16-1 is cut automatically or manually by the tape cutter 12.

Figure 3:
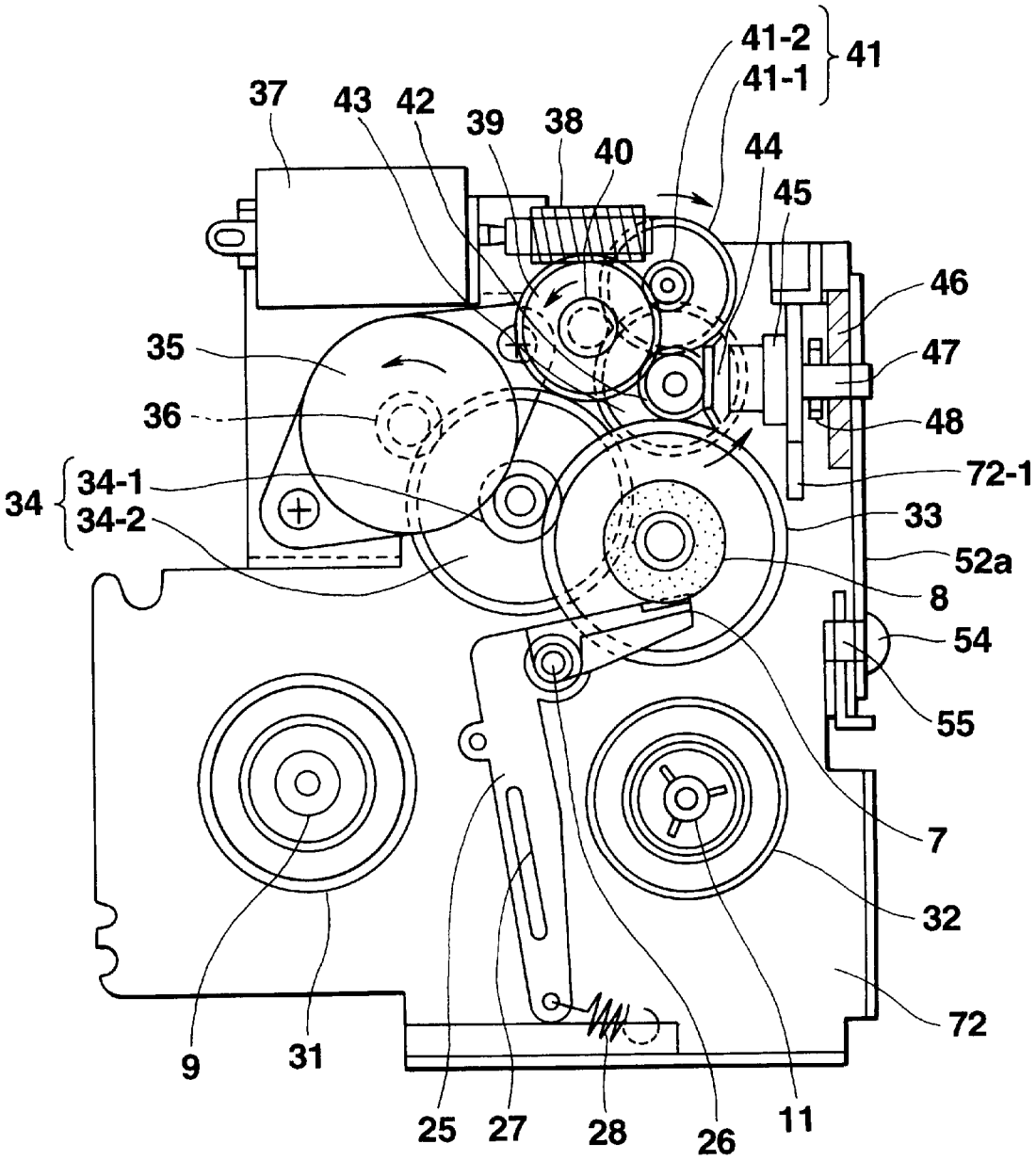
FIG. 3 is a plan view of a tape cutting mechanism of the FIG. 1 printer.
Figure 4:
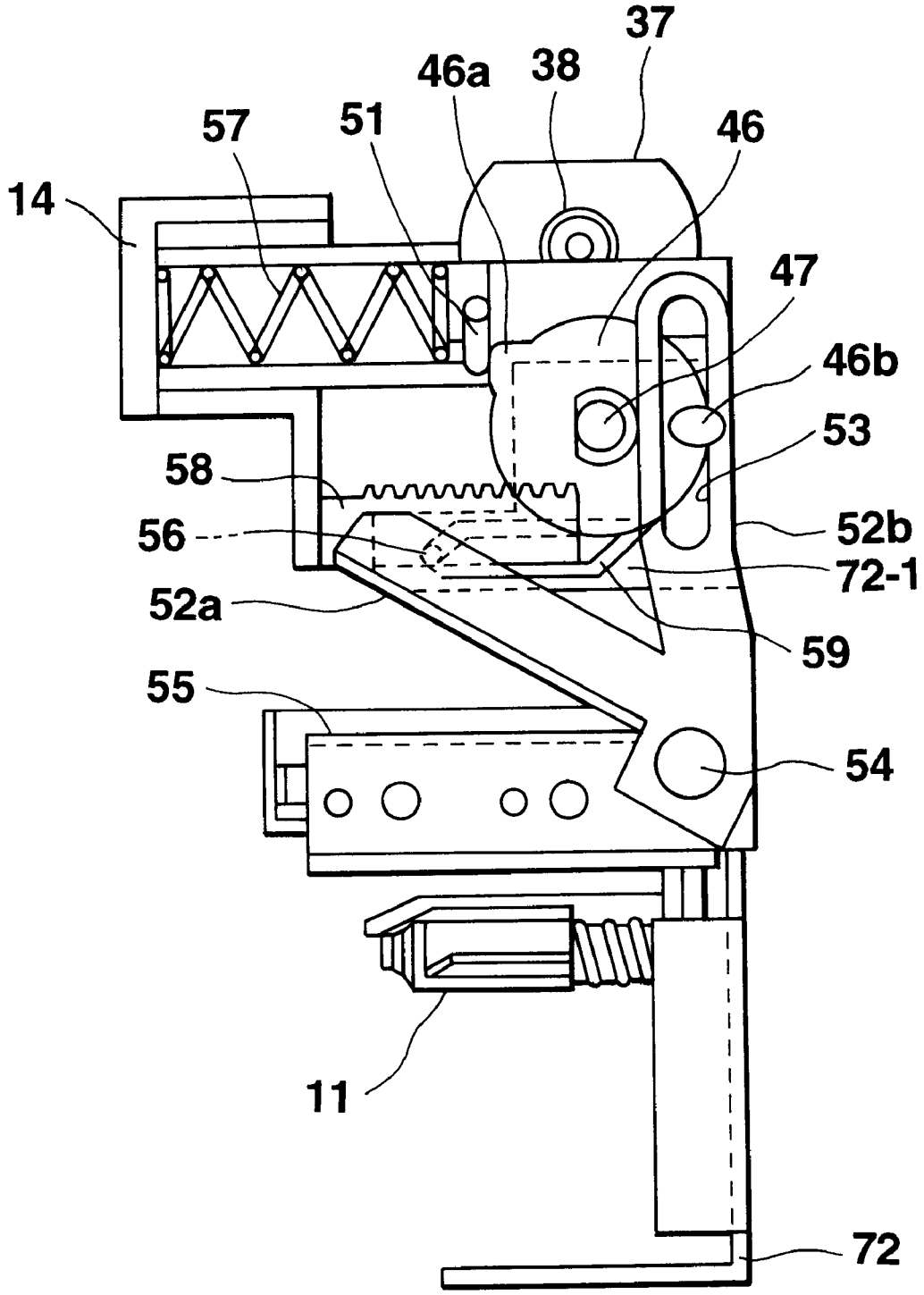
FIG. 4 is a side view of the FIG. 3 tape cutting mechanism with a push button.
Figure 5:
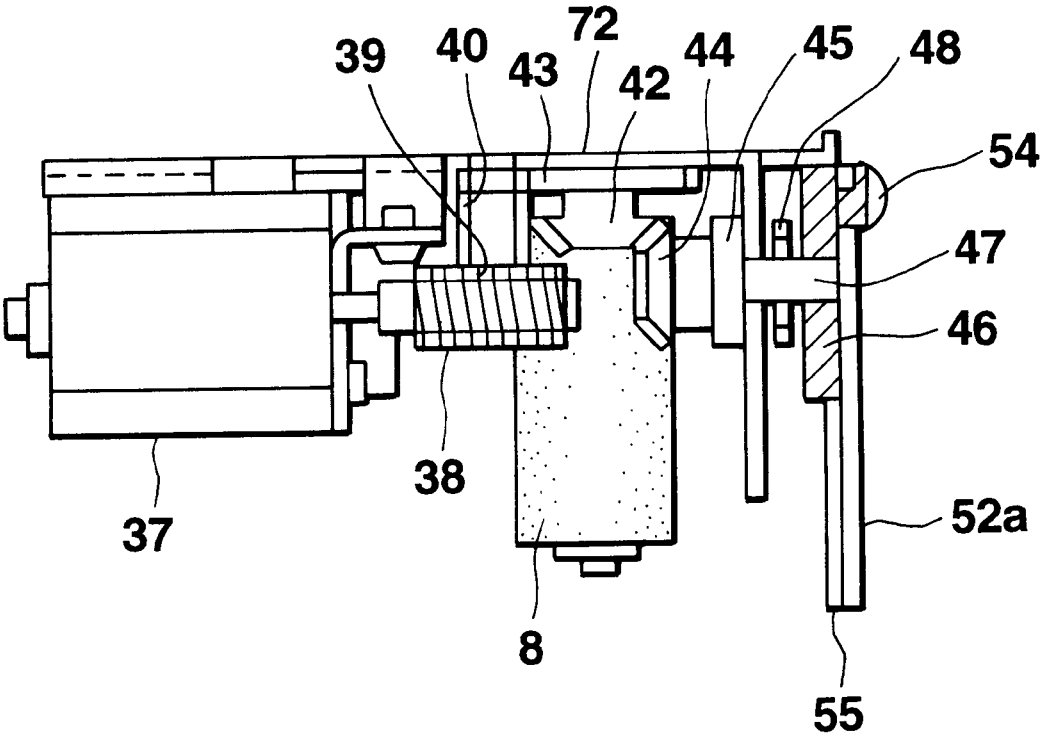
FIG. 5 is a top plan view of the FIG. 3 tape cutting mechanism.

The automatic and manual tape cutting mechanism will be described next. FIG. 3 is a plan view of the cutting mechanism. FIG. 4 is a side view of the FIG. 3 cutting mechanism with a push button 14 attached thereto, and FIG. 5 is a top plan view of the FIG. 3 cutting mechanism with a larger and a smaller gear 41 and 41-1 being not shown. The cutting mechanism of those Figures is disposed at an inner right side of the tape cassette accommodating space 6. FIG. 3 shows the thermal head 7, platen roller 8, tape reel support pin 9 and ink ribbon winding drive shaft 11 of FIG. 1, attached to a frame 72 of the printer body. FIG. 4 also shows the push button attached to the cutting mechanism.

The thermal head 7 is supported turnable at one rear end by a pivot 26 which supports an upper shorter portion of an L-like head arm 25 rotatably to thereby be engaged with the head arm 25, which has a groove 27 extending longitudinally along a longer portion of the L-like head arm 25 into which groove a cam pin (not shown) is inserted. A tensile spring 28 extends between a free end of the longer portion of the L-like head arm 25 and a body frame 72 to bias the head arm 25 counterclockwise. When a cam (not shown) is driven to leftward move a cam pin attached to the cam inserted into the groove 27, the head arm 25 and hence the thermal head 7 turns clockwise around the pivot 26 against the resiliency of the tensile spring 28 to a non-printing position. If the cam pin moves rightward, the head arm 25 and hence the thermal head 7 turn counterclockwise around the pivot 26. Thus, the printing section (heat producing array) provided at the end of the thermal head 7 is pressed through the tape 16 and the ink ribbon 23 (FIG. 1) against the platen roller 8.

The ink ribbon winding drive shaft 11 is engaged with the ink ribbon winding gear 32 connected to a drive system (not shown) and is turned along with the ink ribbon winding gear 32.

The platen roller 8 is provided with a platen gear 33, which meshes with a small diameter gear 34-2 of a speed change gear group 34. A larger gear 34-1 of the gear group 34 meshes with a drive gear 36 of a stepping motor 35. Thus, when the stepping motor 35 rotates forward and backward, the platen roller 8 is also rotated forward and backward, respectively, via the gear group 34.

The cutting mechanism is disposed in a small space between the upper surface of the housing 2 and the body frame 72. In the cutting mechanism, a DC motor 37 (which may be a stepping motor) is disposed so as to perform an automatic cutting operation. Fixed on a drive shaft of the DC motor 37 is a worm 38, with which a worm wheel 39 meshes. A small gear 40 integral with the worm wheel 39 meshes with a larger gear 41-1 of a speed reduction gear group 41, a smaller gear 41-2 of which meshes with a spur gear 43 integral with a bevel gear 42. The bevel gear 42 in turn meshes with another bevel gear 44. Thus, an in-horizontal-plane rotation of the bevel gear 42 driven by the DC motor 37 is converted to an in-vertical-plane rotation of the bevel gear 44. The rotation of the bevel gear 44 is transmitted via a one-way clutch 45 to a cam shaft 47 of a scissors cam 46. A gear 48 is fixed to the cam shaft 47 between the one-way clutch 45 and the scissors cam 46. The gear 48 will be described in more detail later. The cam shaft 47 is supported rotatably by a support 72-1 of the body frame 72.

As shown in FIG. 4 (in which the right and left sides of FIG. 4 represent an upper and a lower surface, respectively, of the printer body), the scissors cam 46 has a radial projection 46*a* formed on a periphery thereof. A sensing switch 51 is disposed on the printer body frame 72 at a position where the sensing switch 51 abuts on the projection 46*a*. When the scissors cam 46 rotates so that when the projection 46*a* presses an end of the sensing switch 51, the sensing switch 51 is turned to be switched on to thereby sense the position of the scissors cam 46.

A pin 46*b* is provided fixedly on the periphery of the scissors cam 46 on the substantially opposite side of the cam shaft 47 from the projection 46*a* so that the pin 46*b* and the cam shaft 47 extend in parallel. The pin 46*b* is inserted into an elongated slot 53 in a turnable arm 52*b* integral with the turnable blade 52*a* of the scissors with an end of the inserted pin 46*b* being bent outside the slot 53 so that the pin 46*b* does not cam off from the slot 53. As described above, when the scissors cam 46 is rotated counterclockwise by the DC motor 37 via the worm 38, worm wheel 39, smaller gear 40, reduction gear group 41, spur gear 43, bevel gears 42, 44, one-way clutch 45 and cam shaft 47, and the turnable arm 52*b* of the scissors is turned by the pin 46*b* around the pivot shaft 54. Thus, the turnable blade 52*a* is closed against the fixed blade 55 of the scissors to thereby automatically cut a printed tape 16-1.

The push button 14 is always biased upward (leftward in the Figure) by a compression spring 57. The push button 14 has a rack 58 formed thereon. The rack 58 has on its back a vertical pin 56 which is engaged in a guide groove 59 formed in a groove forming area 72-1 of the printer frame 72. The push button 14 through the guide groove 59 will be described later in more detail.

First, an automatic cutting operation performed on a printed tape will be described next. FIGS. 6A–6F only show an automatic cutting performed on a printed tape by the scissors cam 46 and its turnable blade 52*a* which are driven by the DC motor 37. FIG. 6A is a part of FIG. 4 which only shows a mechanical section of the printer involving the automatic cutting operation. First, FIG. 6A shows the scissors cam 46 at its reference or home position. As shown, the position of the scissors cam 46 is sensed when the protrusion 46*a* abuts on the sensing switch 51 to thereby turn it. In this state, the pin 46*b* is stopped at a substantially midpoint in the elongated slot 53, so that the turnable arm 52*b* is in a horizontal state. Thus, the turnable blade 52*a* is most open from the fixed blade 55.

When the DC motor 37 starts to rotate, the pin 46*b* starts to turn counterclockwise in combination with rotation of the scissors cam 46, as shown by an arrow A1 of FIG. 6A. As shown by an arrow A2 of FIG. 6B and an arrow A3 of FIG. 6C, when the pin 46*b* further turns to reach to a right-hand end of the elongated slot 53, the turnable blade 52*a* cooperates with the fixed blade 55 to start to cut a tape 16-1.

As shown by an arrow A4 of FIG. 6D, by the continuing rotation of the scissors cam 46, the pin 46*b* further turns to return to a left end of the elongated slot 53 while raising the turnable arm 52*b* up to thereby turn the turnable blade 52*a* further counter-clockwise and hence to completely close the turning and fixed blades 52*a* and 55. This terminates the cutting operation of the scissors.

The scissors cam 46 further continues to rotate, so that as shown by an arrow A5 of FIG. 6E, the pin 46*b* further turns past the midpoint in the elongated slot 53. Thus, the turnable arm 52*b* starts to be pushed down. This causes the turnable blade 52*a* start to turn clockwise to thereby start to open away from the fixed blade 55. As shown by an arrow A6 of FIG. 6F, the pin 46*b* continues to turn to reach a left end of the slot 53, the turnable arm 52*b* and turnable blade 52*a* continue to turn clockwise, and the scissors cam 46 and other elements concerned continue their associated operations to reach the state of FIG. 6A, whereupon the sensing switch 51 senses the protrusion 46*a*, so that the scissors cam 46 and the associated elements stop at their reference positions.

As described above, in the case of the automatic cutting operation, the turnable blade 52*a* of the scissors is automatically driven by the drive of the DC motor 37 to cut the tape 16-1.

The manual cutting operation performed on the printed paper will be described next. FIGS. 7A–7H each show a manual cutting performed by the push button 14 at a respective one of successive stages of the cutting operation. The FIGS. 7A–7H only show a mechanical section of the composition of FIG. 4 for the manual cutting operation. FIGS. 8A–8H each show in a taken-out form a guide groove 59 to be indicated originally in the groove forming section 72-1 of FIGS. 7A–7H for obtaining easy understanding (FIG. 4).

Also, shown in FIGS. 4, and 7A–7H, the rack pin 56 fixed to the back of the rack 58 is illustrated as guided in the guide groove 59. The guide groove 59 takes the form of a parallelogram whose right-hand side is shifted somewhat downward compared to its left-hand side. Valves (not shown) are each disposed at an upper left corner of the parallelogram groove 59 at which the rack pin 56 is at a stop, and at an opposite right lower corner of the parallelogram groove. By those valves, the rack pin 56 is guided always clockwise in the guide groove 59. The valves are arranged to block counterclockwise movement of the rack pin 56 in the guide group 59.

The scissors cam 46 is shown in broken lines in FIGS. 7A–7H in order to illustrate the remaining composition which cannot be seen in FIG. 4 because it is hidden behind the scissors cam 46. First, FIG. 7A shows the scissors cam 46 at its reference position where the pin 46*b* of the scissors cam 46 is stopped at a substantially midpoint in the elongated slot 53 in the turnable arm 52*b*, which shows that the turnable blade 56 of the scissors is completely opened away from the fixed blade. This position of the pin 46*b* corresponds to that of the protrusion 46*a* of the scissors cam 46 sensed by the sensing switch 51, as described above. In this initial state, the rack 58 is disengaged from the gear 48 to be engaged with, so that aforementioned automatic cutting operation is performed without any difficulty.

At this time, as shown in FIG. 8A, the rack pin 56 is positioned at the upper left corner of the guide groove 59.

When in this state the push button 14 is pushed downward against the resiliency of the compression spring 57, as shown by arrows B1 and B2 of FIGS. 7A and 7B, the rack 58 fixed to the push button 14 starts to lower. As shown in FIG. 8B, this causes the rack pin 56 to lower clockwise along the guide groove 59, which causes the rack 58 to move rightward along with the push button 14, as shown in FIG. 7B. The cylinder 14*a* of the push button 14 which contains the compression spring 57 is fitted loosely over a push button support 61 on the printer body frame and freely adapts to horizontal movement of the rack 58. The rack 58 moves rightward while lowering to mesh at one end with the gear 48. The push button 14 is further pushed down as shown by arrows B3 and B4 of FIGS. 7C and 7D, and the scissors cam 46 is rotated counterclockwise via the rack 58, gear 48 and cam shaft 47. At this time, the rack pin 56 starts to lower along the guide groove 59, as shown in FIGS. 8C and 8D.

In the case of the manual cutting operation involving pushing the push button 14 down, as described above, the rotation of the cam shaft 47 is transmitted to the DC motor 37. Thus, the rotation of the cam shaft 47 would originally be braked by the bevel gear 44 although the reverse drive force from the cam shaft 47 exerted on the bevel gear 44 is absorbed by the intervening one-way clutch 45 and not transmitted to the bevel gear 44. Thus, the cam shaft 47 turns without receiving any braking force and hence the scissors cam 46 rotates.

By the rotation of the scissors cam 46, the turnable blade 52*a* is turned until the pin 46*b* reaches the right-hand end of the slot 53 in the turnable arm 52*b* of the scissors, as in the case of FIG. 6C, so that the turnable and fixed blades 52*a* and 55 cooperate to perform a cutting operation on the tape 16.

Subsequently, when the push button 14 is pushed down, as shown by an arrow B5 of FIG. 7E, the rack 58 further lower to rotate the scissors cam 46, so that as in FIG. 6D, the pin 46*b* turns to return toward the left end of the slot 53 while raising the turnable arm 52*b* up. Thus, the counterclockwise turning of the turnable blade 52*a* further proceeds and, as shown in FIG. 7E, the turnable and fixed blades 52*a* and 55 are completely closed against each other to thereby terminate the cutting operation by the scissors.

When the push button 14 is further pushed down, as shown by an arrow B6 of FIG. 7F, the scissors cam 46 further continue to rotate, and the pin 46*b* rotates past the midpoint in the slot 53 to start to push the turnable arm 52*b* down, which causes the turnable blade 52*a* to turn clockwise to thereby start to open away from the fixed blade 55.

When the push button 14 is further pushed down, as shown by an arrow B7 of FIG. 7G, the rack pin 56 lowers along the guide groove 59, as shown in FIGS. 8E–8G. Until the rack pin 56 reaches the lowermost (right-hand) end of the guide groove 59, as shown in FIG. 8H, the rack 58 is lowered to further rotate the scissors cam 46, as shown in FIG. 7H. Thus, the pin 46*b* which has reached the left-hand end of the elongated slot 53 and then returned to the midpoint in the slot 53 stops at its initial position shown in FIG. 7A, where the turnable blade 52*a* of the scissors is completely open away from the fixed blade 55, and where the protrusion 46*a* of the scissors cam 46 is sensed by the sensing switch 51.

As described above, the gear ratio between the rack 58 and the gear 48 is set so that by a single push (stroke) operation of the push button 14 the gear 48 and hence the scissors cam 46 make a single complete rotation and hence the turnable blade 52*a* performs a single cutting operation.

Thereafter, the pushing-down operation of the pushed button 14 is released and the push button 14 is raised by the resiliency of the compression spring 57, as shown by an arrow B8 of FIG. 7H. Thus, the rack 58 is also raised at this time. At this time, the rack pin 56 is guided by the valve (not shown) disposed in the guide groove 59 to move leftward and then rise in the guide groove 59. Thus, the meshing state of the rack 58 and the gear 48 is released simultaneously with the time when the rack pin 56 starts to rise, and the initial position of the scissors is maintained.

While in the above embodiment the engagement/disengagement of the rack 58 of the manual device with/from the gear 48 of the cam shaft 47 are performed through the guide groove 59, the engagement of the gear 48 of the cam shaft 47 with the manual device is not limited to this particular case, but may be realized in another arrangement, which will be described next as a second embodiment of the present invention.

Second Embodiment

Figure 9:
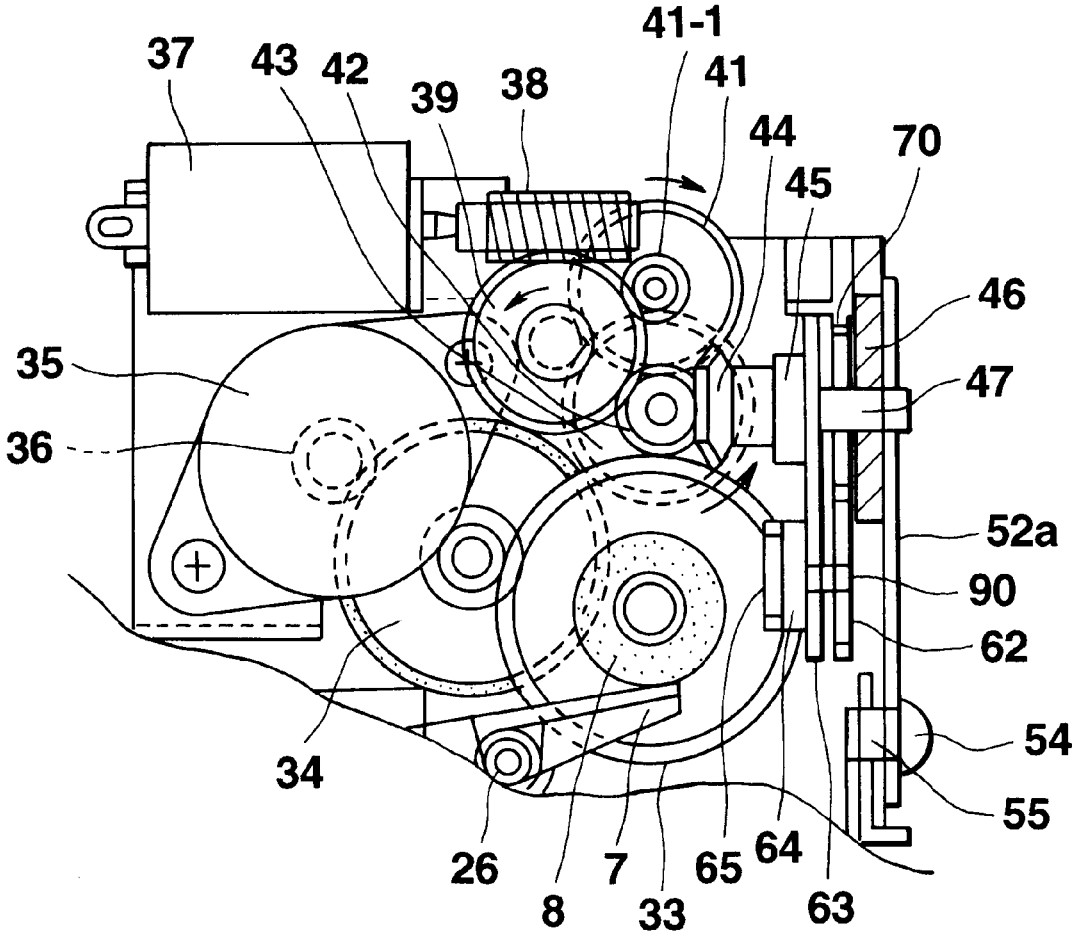
FIG. 9 is a plan view of a tape cutting mechanism of a printer of another embodiment according to the present invention.
Figure 10:
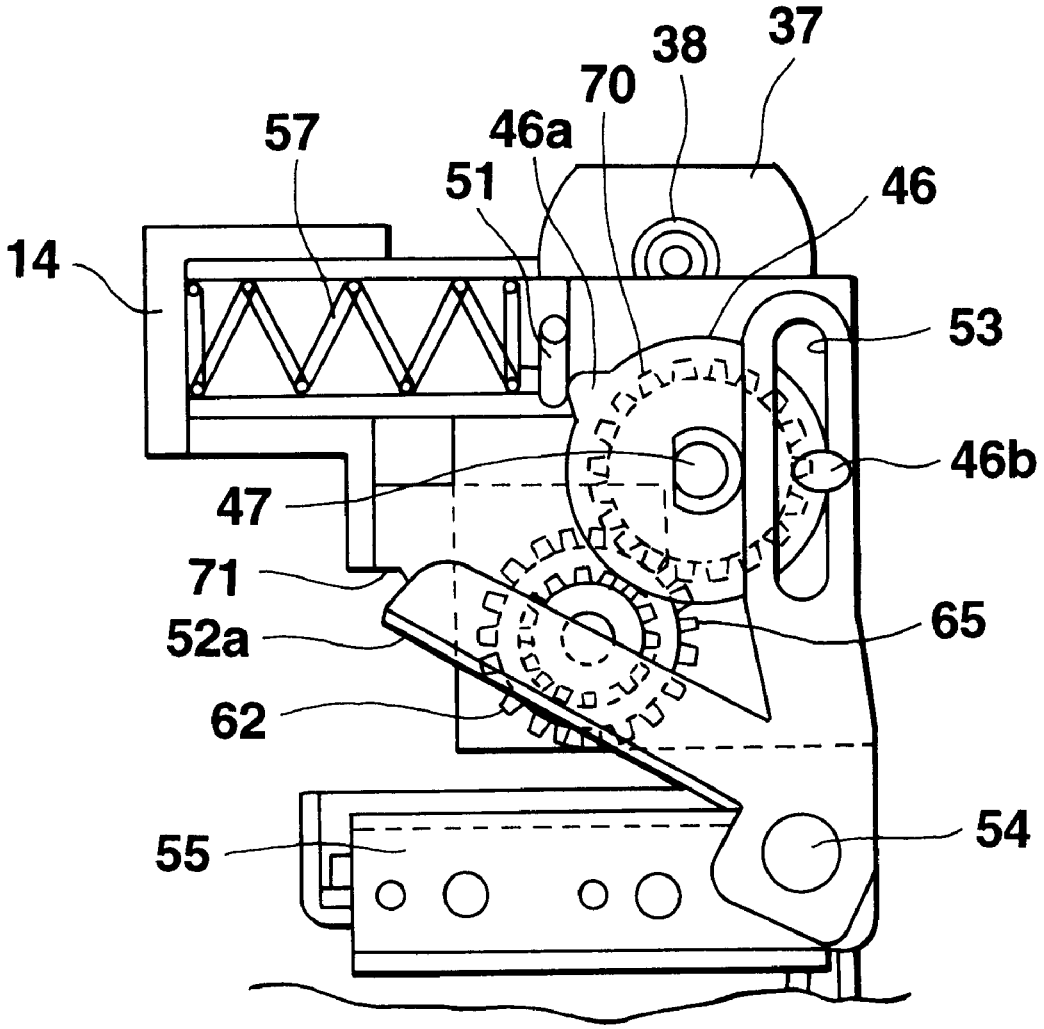
FIG. 10 is a side view of the FIG. 9 tape cutting mechanism with a push button attached thereto.
Figure 11:
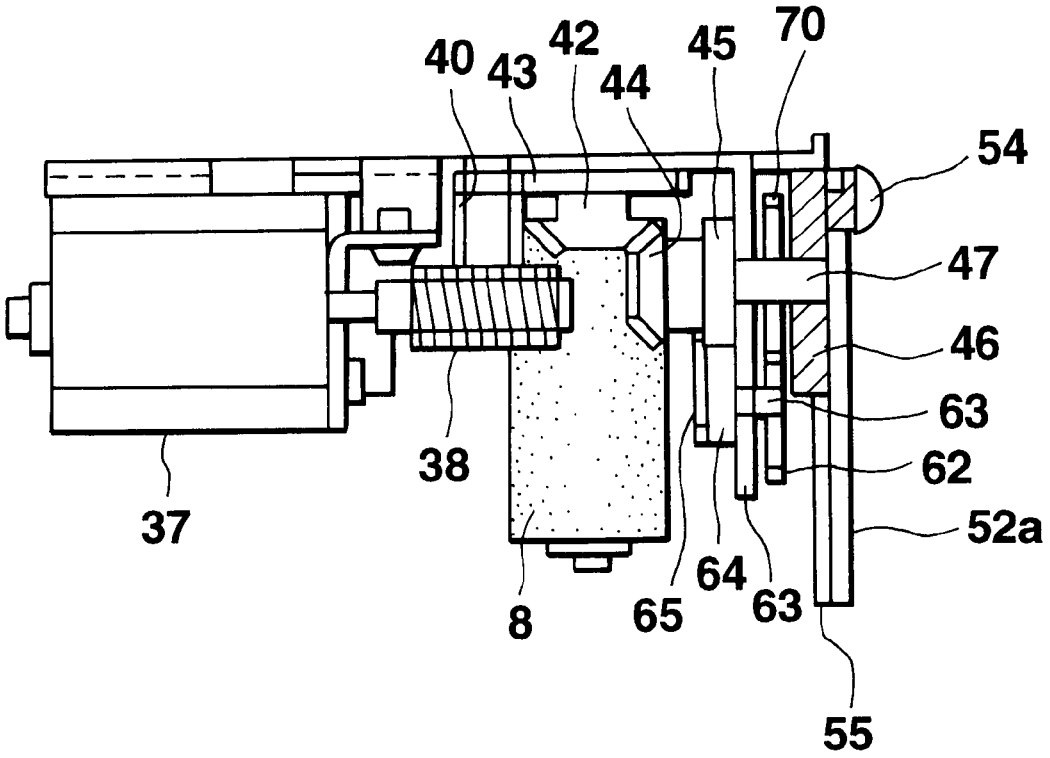
FIG. 11 is a top plan view of the FIG. 9 tape cutting mechanism.
Figures 12A, 12B, 12C:
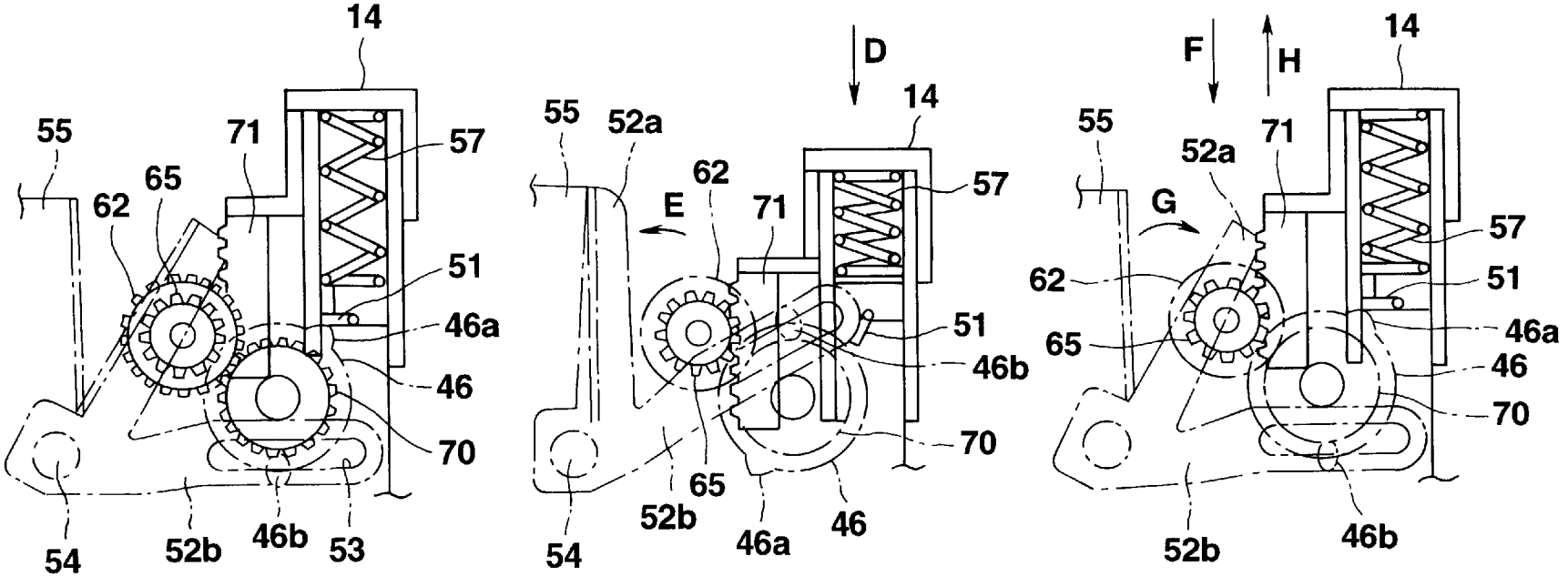
FIG. 12A illustrates a stage of a manual cutting operation of a printed medium by a push button of a further embodiment according to the present invention.
FIG. 12B illustrates another stage of the manual cutting operation of the printed medium by the push button of the further embodiment according to the present invention.
FIG. 12C illustrates still another stage of the manual cutting operation of the printed medium by the push button of the further embodiment according to the present invention.

FIG. 9 is a plan view of a cutting mechanism of the second embodiment. FIG. 10 is a side view of the cutting mechanism of FIG. 9. FIG. 11 is a plan view of the cutting mechanism of FIG. 9 with larger and smaller gears 41 and 41-1 being omitted. FIGS. 12A, 12B and 12C show the respective successive stages of operation of the cutting mechanism. In that case, the same element of FIGS. 9–11 and 3–5 is given the same reference numeral and further description thereof will be omitted.

In FIGS. 9–11, a gear 70 different in the number of teeth from the gear 48 of FIGS. 3 and 5 is fixed to the cam shaft 47 between the one-way clutch 45 and the scissors cam 46. The gear 70 meshes with another gear 62, whose rotational shaft 90 is supported by the frame 63 of the printer body and connected via a manual one-way clutch 64 to the gear 65, which meshes always with a rack 71.

FIG. 12A substantially includes FIG. 10 which shows the FIG. 10 cutting mechanism at its reference position. As shown by arrow D of FIG. 12B, when the push button 14 is pushed down against the resiliency of the compression spring 57, the rack 71 fixed to the push button 14 lowers to rotate the gear 65 clockwise, which rotates the scissors cam 46 counterclockwise in FIG. 12B via the manual one way clutch 64, gears 62, 70 and cam shaft 47, as shown in FIGS. 9–11. Thus, the turnable arm 52*b* and the turnable blade 52*a* turn toward the fixed blade 55, as shown by an arrow E to thereby cut the tape 16-1.

Thereafter, as shown by an arrow F of FIG. 12C, the push button 14 is pushed down to its lowermost end to complete one rotation of the scissors cam 46. Thus, the turnable blade 52*a* which has terminated its cutting operation opens completely as shown by an arrow G in FIG. 12C, and the scissors and the scissors cam 46 are again set at their respective reference positions. Also, in this embodiment, the gear ratio between the rack 71 and gears 65, 62 and 70 is set so that by a single push (stroke) operation of the push button 14 the scissors cam 46 makes a single complete rotation and the turnable blade 52*a* performs a single cutting operation.

Thereafter, when the pushing operation of the push button 14 is released, the push button 14 rises by the resiliency of the compression spring 57, as shown by an arrow H of FIG. 12C. Thus, the rack 71 also rises and the gear 65 rotates. This rotation of the gear 65 is absorbed by the intervening manual one-way clutch 64 and not transmitted to the gear 62. Thus, the scissors cam 46 does not rotate, so that even after the pushing operation of the push button 14 is released, the respective reference positions of the scissors cam 46, turnable arm 52*b* and turnable blade 52*a* are maintained unchanged.

In a small printer, the output of cells used can often drop during printing. Usually, when the cell output drops, a corresponding message appears, creation/storage of printing data is possible with the cell whose output has dropped. When a large load operation such as tape cutting is performed, however, power consumption is high, so that the printer would stop if the automatic cutting system is employed and the printing operation continues with the low cell output. In this case, when no receptacle can be available, the printing operation cannot continue. If the manual cutting operation is possible even in such a case, it is very convenient for the user.

While in any of the aforementioned embodiments the printers which perform both the automatic and manual tape cutting operations are illustrated, the push button 14, compression spring 57, rack 58, rack pin 56, guide group 59 and gear 48 may be removed from the first embodiment to form such a cutting mechanism which is capable of performing only an automatic cutting operation with the aid of the DC motor 37. Alternatively, the DC motor 37, worm 38, worm wheel 39, smaller gear 40, reduction gear 41, spur gear 43, bevel gears 42, 44 and one-way clutch 45 may be removed to form such a cutting mechanism which is capable of performing only a manual cutting operation with the aid of the push button 14. This applies to other embodiments. As just described above, arrangements for both the automatic and manual cutting operations, only the automatic cutting operation and only the manual cutting operation are easily fabricated. In other words, when manufactured high-grade printers through inexpensive ones which do not need any motors and are easy to control are lined up, it will be seen that many common parts or components may be used in design and assembling those articles.

While any of the embodiments is arranged so that in the case of the manual cutting operation the manual force is transmitted via the gear 48 to the cam shaft 47 and the scissors cam 46 in this order, the present invention is not limited to this particular case. For example, the gear 48 may be integral with the scissors cam 46 so that the manual force is transmitted to the scissors cam 46. Alternatively, an embodiment may be arranged so that the manual force is directly transmitted to the turnable blade 52*a* without being transmitted through the gear 48, cam shaft 47, and scissors cam 46.

While in any of the embodiments the automatic and manual cutting mechanism for the printers which perform a monochromatic printing has been illustrated, the present invention is not limited to the particular case. For example, the inventive automatic and manual cutting mechanism applies also to a full-color printer.

In full-color printing, three primary color inks of yellow, magenta and cyan are coated repeatedly in this order in longitudinally successive areas on the ink ribbon 23 for subtractive color mixture. An yellow ink of the three primary color inks in which characters are to be printed is first set at the printing position in the ink ribbon, and the characters are then printed in that color on a portion of the tape 16. The printed tape portion 16-1 is then rewound. To this end, the tape reel support pin 9 is engaged with a driver system (not shown) to be turned, as shown in FIG. 3. Similarly, the next primary color, magenta, is then set at the printing position, and the characters are then printed in that color on the printed portion 16-1 of the tape 16. The printed tape portion 16-1 is then rewound. Finally, the last primary color, cyan, is then set at the printing position, and the characters are then printed in that color on the printed portion 16-1 of the tape 16. The tape portion 16-1 printed in the superposed primary colors is then fed out through the tape cutter 12 from the tape discharge port 13, whereupon the printed portion is cut automatically or manually by the tape cutter 12.

While in the first embodiment the guide groove 59 is illustrated as formed in the groove forming area 72-1 of the printer body frame 72, the present invention is not limited to this particular case. For example, a guide groove such as shown by 59 may be provided directly in the housing 2 of the printer body.

I claim:

1. A printer for printing an image or character on a tape-like printing medium, comprising:

a cutter member for cutting the printing medium;

a cutter drive source;

a drive force transmitting means for transmitting a drive force from said cutter drive source to said cutter member to operate said cutter member; and a manually operating mechanism for manually operating said cutter member independent of the operation of said cutter member based on said cutter drive source; wherein said drive force transmitting means comprises a one-way connecting means, responsive to said cutter member being operated by said manually operating mechanism, for absorbing a reverse drive force transmitted reversely from said cutter member to said cutter drive source.

2. The printer according to claim 1, wherein said manually operating mechanism comprises an operated member operated manually and a manual force transmitting member engaged with said operated member for transmitting a manual force from said operated member to said cutter member.

3. The printer according to claim 2, further comprising disengaging means, responsive to transmission of a manual force from said operated member via said manual force transmitting member to said cutter member having been completed, for disengaging said operated member from said manual force transmitting member.

4. The printer according to claim 3, wherein said disengaging means comprises a pin attached to said operated means and a groove formed in a printer body in which said pin is guided.

5. The printer according to claim 2, wherein said operated member comprises a button having a rack.

6. The printer according to claim 2, wherein further comprising an operating-force transmission releasing means, responsive to a manual force being transmitted from said operated member via said manual force transmitting member to said cutter member, for preventing said cutter member from transmitting an operating force to said manual force transmitting member.

7. The printer according to claim 6, wherein said operating-force transmission releasing means comprises a manual one-way connecting means for absorbing a reverse drive force transmitted from said cutter member to said manual force transmitting member.

* * * * *

UNITED STATES PATENT AND TRADEMARK OFFICE

CERTIFICATE OF CORRECTION

PATENT NO. : 6,030,135

DATED : February 29, 2000

INVENTOR(S) : Kazuhide Imai

It is certified that error appears in the above-identified patent and that said Letters Patent is hereby corrected as shown below:

On the title page, item [54] and Column 1,

In the title, change "CUTTING MEANS" to --CUTTER--.

Signed and Sealed this

Fifteenth Day of August, 2000

*Attest:*

Q. TODD DICKINSON

*Attesting Officer*

*Director of Patents and Trademarks*